US006260847B1

(12) United States Patent
Lueder

(10) Patent No.: US 6,260,847 B1
(45) Date of Patent: Jul. 17, 2001

(54) OBLIQUE CHESSBOARD

(76) Inventor: Lawrence A Lueder, 698 Bridgeton Pike, Mantua, NJ (US) 08051-1351

( * ) Notice: Subject to any disclaimer, the term of this patent is extended or adjusted under 35 U.S.C. 154(b) by 0 days.

(21) Appl. No.: 09/504,171

(22) Filed: Feb. 15, 2000

(51) Int. Cl.[7] ..... A63F 3/02
(52) U.S. Cl. ..... 273/261; D21/348; D21/349
(58) Field of Search ..... 273/260–262; D21/348, 349

(56) References Cited

U.S. PATENT DOCUMENTS

D. 402,709 * 12/1998 Colebank ..... D21/349
D. 409,671 * 5/1999 Baker ..... D21/348

OTHER PUBLICATIONS

"Chess II", Ungame Co., Games Magazine, Jul./Aug. 1978, p. 7.*
"Catastrophic 8 × 8 Chess", A. Missoum, www.chessvariants.com, Jun. 1997.*
"Knot Chess", A. Missoum, www.chessvariants.com, Jun. 1997.*
"Chessopoly", Ralph Betza, www.chessvariants.com, Jun. 1997.*

* cited by examiner

*Primary Examiner*—Benjamin H. Layno

(57) ABSTRACT

A chessboard that is oblique like in form for playing conventional chess or checkers. The chessboard is flat two-dimensional and typically kidney shaped with sixty-four identifiable curved playing spaces. Players can play opposite each other or on the same side depending on the oblique chessboard configuration chosen. A plus for games to play on an airline is the oblique chessboard where opponents play from the same side. The playing field can be manufactured to look like a fishpond or golf course, etc. with sixty-four identifiable curved playing spaces. Another object of the invention is to provide a more aesthetically pleasing form for a tabletop chessboard configuration instead of the conventional square checkerboard look. And still another object of this invention is to provide a chessboard with sixty four playing spaces with color shading from light to dark verses conventional boards with just two colors, black and white etc.

6 Claims, 9 Drawing Sheets

OBLIQUE CHESSBOARD

CROSS REFERENCE TO RELATED APPLICATION

Not application

STATEMENT REGARDING FEDERALLY SPONSORED RESEARCH OR DEVELOPMENT

Not application

REFERENCE TO MICROFICHE APPENDIX

Not application

1. Field of the Invention

This invention relates generally to chess game boards

2. Description of Prior Art

The game of chess or checkers has been played by two players on a rectangular figured chess board containing 64 squares, alternately colored light and dark, with two sets of 16 chess peaces. Players face one another with their game pieces taking up the rows of squares closet to them. Many variations to this game were invented and patented, none are like my invention, some examples:

| | | | | |
|---|---|---|---|---|
| D251862 | D262897 | D289532 | D299933 | D306322 |
| D317791 | D369626 | D376824 | D409671 | 3851883 |
| 4093237 | 4249740 | 4322085 | 4580787 | 4778187 |
| 4856789 | 5197742 | 5403005 | 5421582 | 5449178 |
| 5492332 | 5577730 | 5536014 | 5536015 | 5647593 |
| 5662329 | 5692754 | 5735523 | 5871212 | |

None of the Design or Utility Patents listed above remotely looks like or is played like this invention. In all the above listed prior art, the invention was either rectangular or circular in configuration. My invention is a board that is fluid like in appearance. Some others not listed were three-dimensional, concave, convex, multi-player games or used symbols within the squares to add complexity to the original game. The art of the game is similar, but the complexity of the distortion from my board makes my game more difficult to play and to maintain one's sanity. My board is oblique and fluid like in design.

Patent D251862 is the only design that closely matches my invention. This patent uses the 64 total playing units per a typical chess playing field. The difference is that this board is a concentric circle board. Patent D251862, D262897, D289532, D306322, D369626, D376824, D409671 and 4322085 are all concentric type boards unlike my invention. Patent D299933 is a three dimensional game board and uses raised block squares. Patent D317791 uses more than 64 playing squares or units. Patent 3851883 uses more than 64 squares to play. Patent 4093237 is a chessboard game played with more than two players. Patent 4249740 is playing checkers and chess at the same time on a rectangular board. Patent 4580787 is a rectangular board with hex-like squares. Patent 4778187 uses more than 64 squares. Patent 4856789 is a multi player game. Patent 5197742 is a chessboard with magnetic chess pieces. Patent 5403005 is a chessboard with removable blocks. Patent 5421582 is a rectangular board with hexagon squares. Patent 5449178 is a different method of playing same where captured pieces become pawns. Although patent 5492332 uses a pentagonal shaped playing field, it is different than mine in that this invention uses one-hundred eighty squares. Patent 5577730 is a chessboard that converts into a carrying case. Patent 5536014 is a chessboard with numbers and letters in the spaces to add complexity. Patent 5536015 is a chessboard game using valuable symbols and items to teach children economics. Patent 5647593 is a chessboard game using fewer pieces to teach children how to play. Patent 5662329 is a three dimensional game board. Patent 5692754 is a rectangular 2 level board. Patent 5735523 is a modified board with two extra columns. And patent 5871212 is a chessboard that comes apart like a puzzle.

BACKGROUND OF THE INVENTION

The invention relates to a radically modified chess board made to look like modem fluid art. The board is not three-dimensional and does not incorporate any of the complex symbols within the board to make the game any different other than to make it more insane to play. Maybe it can't be played and will just sit like a coffee table top, intriguing or challenging the best of minds. The best use for one of the designs, FIG. 2, is that it can used to play chess with opponents seated on the same side like when seated on an airline. The majority of my invention boards are intended to not have sharp edges or straight-line designs, but flow like wood grain with intersecting similar grains. The boards are distortions of chessboard designs as if one were to take a plastic chessboard and melt it. Melted and twisted into some of the various forms I've shown in the figures better describes one of my oblique chessboards.

An object of this invention is to provide a distorted chess game board that may be played by only the best and well versed in the art. Another object of this invention is to provide a distorted chess game board that incorporates all the interest of conventional chess game but that provides a twist of insanity to those willing to challenging playing the game. Still another object of this invention is to provide a distorted chess game board that can be used as an alternate coffee table top verses present-day rectangular checkerboard tops, modern art.

A further object of this invention is to provide a distorted chess game board that can be played as if the players were playing in outer space. Played as an outer space chess game, pawns reaching opposite ends of the board enter into other dimensions. In the other dimension, the player can begin to play another totally different game. See description specifications for details.

And still another object of this invention is to create a chess board game that forces the players to have to think in a fluid like manner verses a straight line and box type mentality of conventional chessboards. Keeping track of an opponent's position and concentrating on rank, threat and ability is somewhat easy with conventional square chessboards. Converting fluid lines to square boxes per my invention in one's mind adds additional challenges.

Rectangular and polygon like boards are shown to demonstrate similarities to this invention in straight-line form. Although the straight-line forms can be manufactured their appeal aesthetically is questionable. Also note that although this invention does not address chess pieces, I left that up to the imagination of the manufacturer. Some chess piece suggestions would be, to manufacture them to appear like melted soldiers, maybe all the same height, color or size to add difficulty. Why should pawns all look the same, do people? And are all castles the same in appearance, etc? Subtle differences in chess piece appearances would be a welcome addition to this game.

SUMMARY OF THE INVENTION

Accordingly, it is an object of the present invention to provide a chessboard device of oblique configuration. The game is played similar to a conventional chess game, except that 16 curved lines that make up the 64 playing spaces adds more mental concentration and challenge.

SPECIFICATION

The specification I'm providing is only intended as a guide and many other forms of this invention are possible. I will attempt to describe some of the many potential game possibilities from this invention as well as other potential uses. This invention is a chess-type board game apparatus and method of playing the same with a modified chess board having a main oblique playing field and a generally anatomical shaped field extending from one side thereof. The playing field as a whole comprises sixty-four oblique forms of alternating color. The best way to describe this board is to visualize a standard rectangular chess like board made of plastic that has been melted with heat. None of the squares retain their original form and appear distorted, oblong with curves, elastic stretches and swirls. Even the perimeter of the chessboard is deformed to appear like a fishpond. No limitations are provided regarding the makeup of material used, game packaging, color, etc. that is per manufacturer preferences.

This invention can be manufactured like tabletop games, furniture or as decorative artwork. Decorative artwork is oblique like tabletops, stand alone figures or hang up pictures with the sixty-four oblique designed units of alternating colors. No longer will chess players have to contend with only rectangular shaped chessboards with rigid equally spaced and parallel lined rectangles. My invention is more pleasing to the eye because it doesn't conform to modern day living structured standards, whereby everything is rectangular with straight lines or a concentric figure or image. The manufacturer can op to make each board different and unique or all similar in design and function.

Before going into details I must explain that the word chessboard and checkerboard is one in the same. Many of the figures do not show the alternating shaded areas to ease viewing and understanding for those versed in the art. FIGS. 1 through 4 and 6 through 11 all have the required number of playing spaces of sixty-four units. Shading can also be any suitable markings, such as "X" or symbols. It is understood that the phraseology employed herein is for the purpose and not of limitation.

Figure 1:
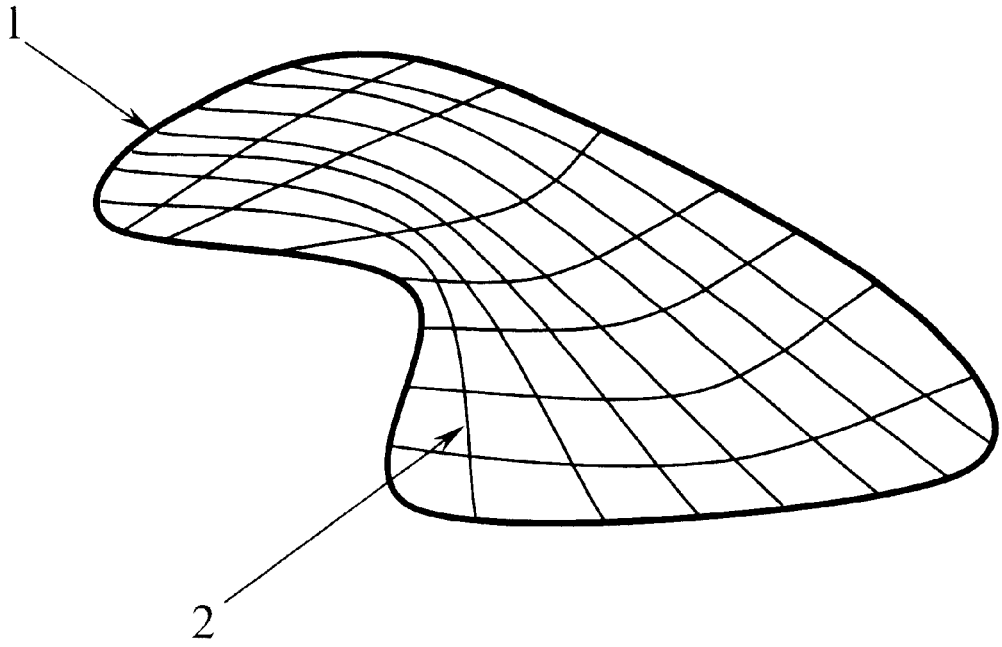
FIG. 1 is a drawing of an oblique chessboard where opponents play or sit across from one another.

Referring now to the drawings the embodiment of the invention is disclosed in FIG. 1. Variations of this chessboard are shown in FIGS. 2 through 11. And now, FIG. 1 is an oblique kidney shaped chessboard 1 with smooth curved lines 2 and curved perimeter. The exacting configuration is one of many possibilities too infinite in design possibilities to detail each one. FIG. 1 demonstrates lines 2 that are somewhat pleasing to follow and tend to align with their respective perimeters. Players play opposite each other.

Figure 2:
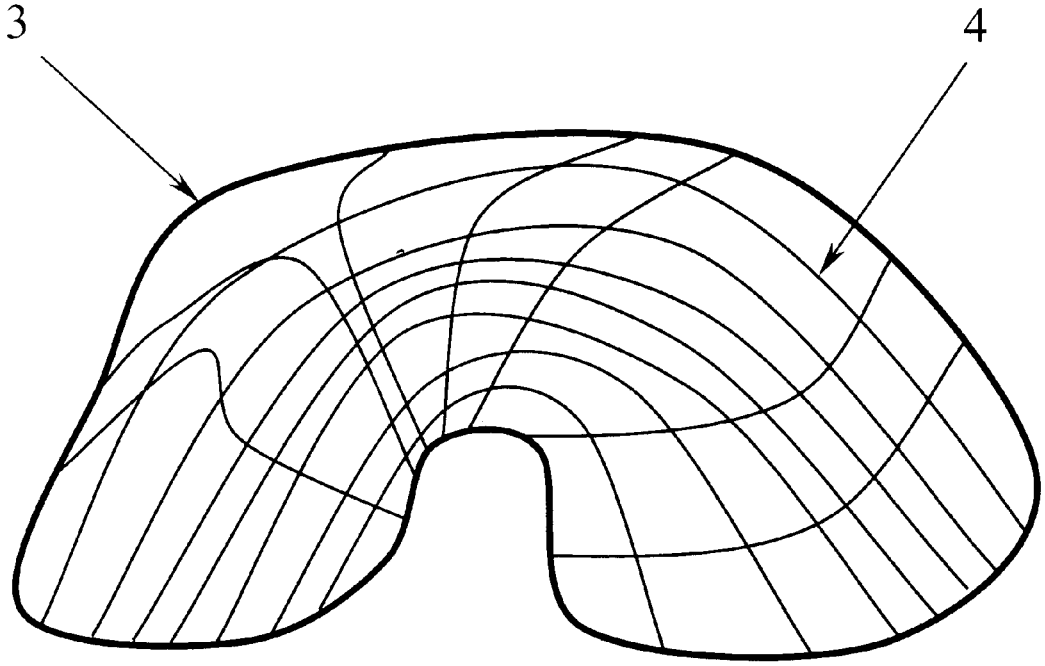
FIG. 2 is a drawing of an oblique chessboard where opponents play or sit on the same side.

FIG. 2 is an oblique kidney shaped chessboard 3 with smooth curved lines 4 and curved perimeter. This configuration shows lines 4 that do not necessarily align with their respective perimeters. Players play on the same side.

Figure 3:
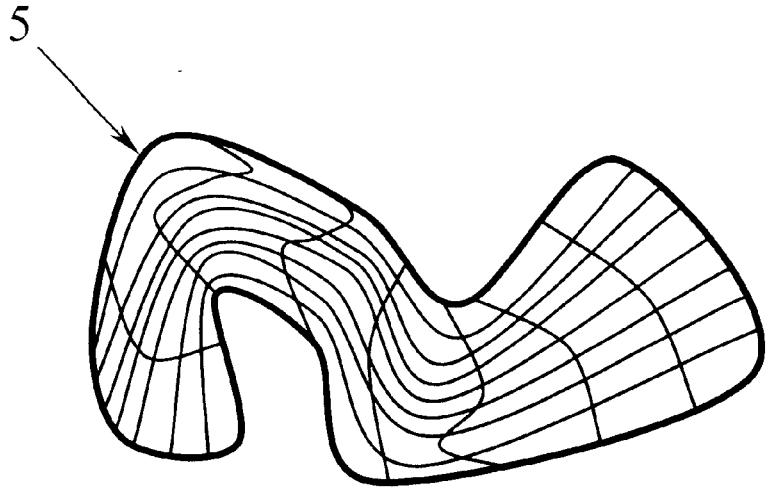
FIG. 3 is a drawing of an oblique chessboard where the board is "S" shape.

FIG. 3 is an oblique "S" shaped chessboard 5 with a complex fluid like form. The lines like FIG. 2 need not align with their respective perimeters. This figure is to demonstrate yet another possibility for FIG. 2.

Figure 4:
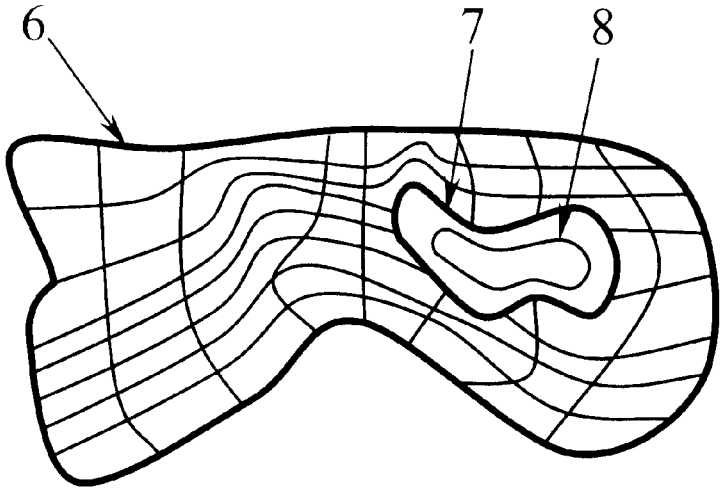
FIG. 4 is a drawing of an oblique chessboard with hole.

FIG. 4 is yet another oblique chessboard 6 like FIG. 1, except this one incorporates a hole 7 and possible landing space 8. The added hole 7 is there to confuse the players. The hole 7 also allows the manufacturer to apply any additional game/s within the hole 7 space. Games such as Monopoly, Chinese Checkers, etc. can be adapted to this open spot. So for example, instead of opting for an alternate chess piece once a pawn piece reaches the opposite side, he can instead get a head start playing monopoly buying up property within the hole 7. FIG. 4 chessboard 6 can also be played as if the players were playing chess in space and the hole 7 is considered a black hole in space. Once one of the players reaches the opposite side he can enter the black hole 7 back to earth to buy up property per the game Monopoly before his opponent gets there. The possibilities for FIG. 4 chessboard 6 are many and this is just one example.

Figure 5:
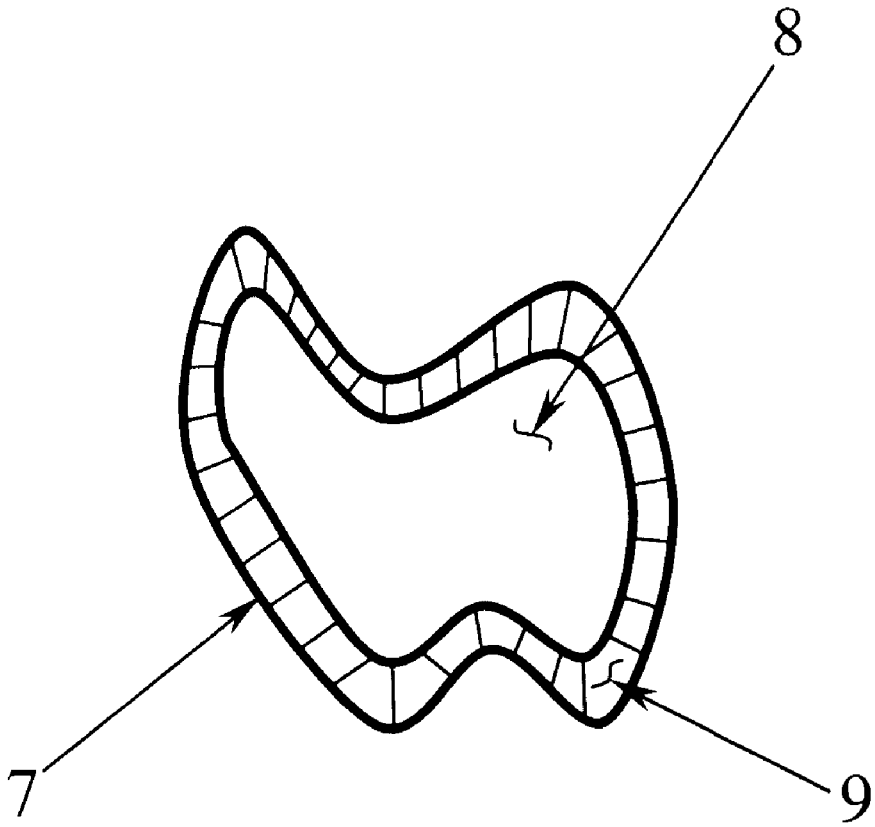
FIG. 5 is the hole from FIG. 4 showing other potential game location.

FIG. 5 is a magnified-view of the hole 7 from FIG. 4 showing one example of the individual property squares 9 of a similar game such as monopoly. The perimeter can conform to any shape per manufacturer preferences. The quantity of holes 7 is also per the manufacturer's preferences should they elect to add additional games or difficulty to the original game.

Figure 6:
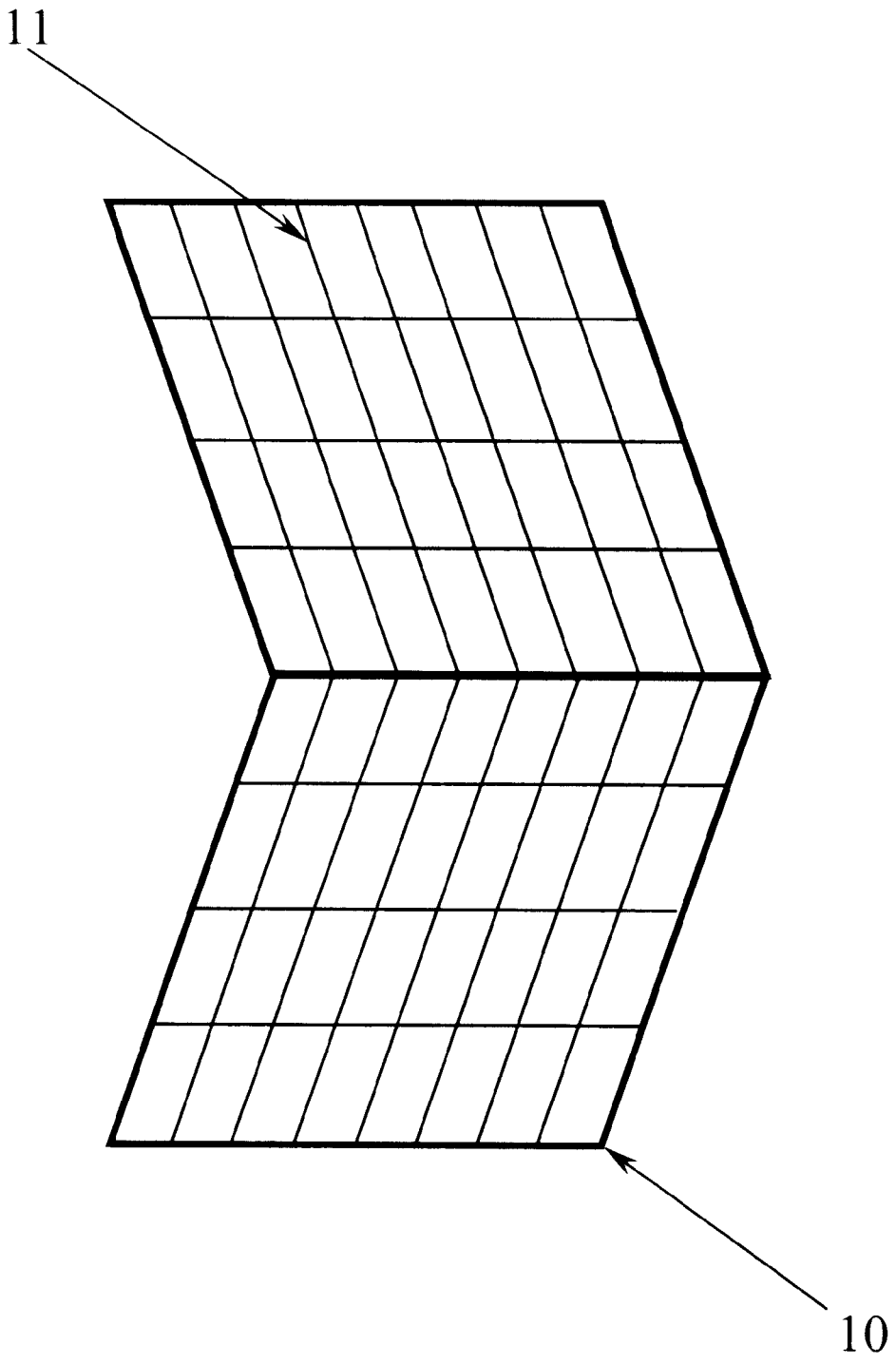
FIG. 6 is a polygon like chessboard with even spaced rectangular playing spaces.

FIG. 6 polygon chessboard 10 shows equally spaces lines 11 or equally sized parallelograms. This board is very much like FIG. 1, except it uses the more familiar conventional straight lines 11 we are most used to seeing and comprehending. This figure is used to better understand FIG. 1 whereby the players play opposite each other. The difficulty manifests itself whenever players attempt to assess diagonal chess piece movements.

Figure 7:
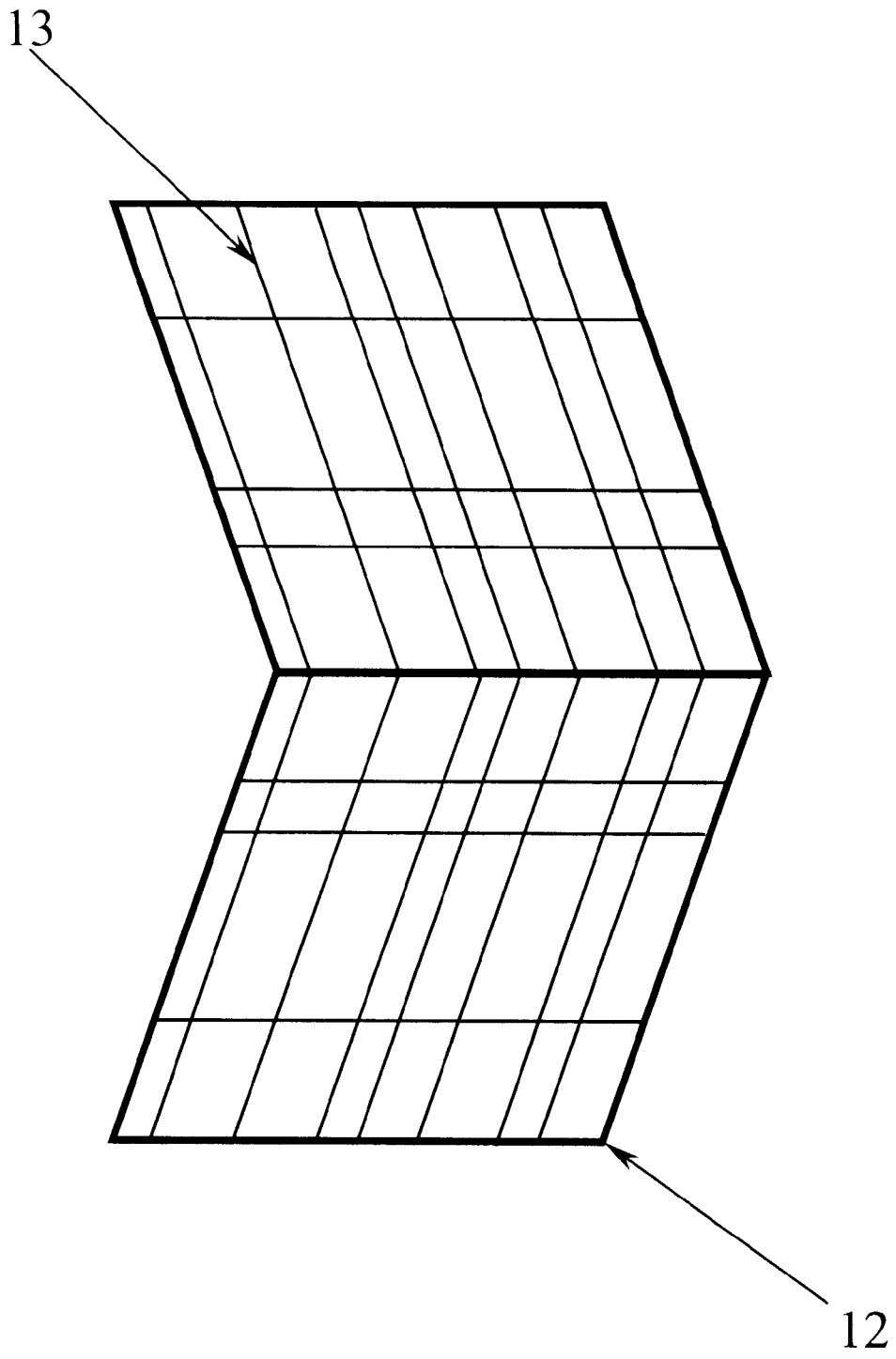
FIG. 7 is a polygon like chessboard with uneven rectangular playing spaces.

FIG. 7 is a polygon chessboard 12 similar to FIG. 6 with unequally spaced lines 13 or parallelograms. Like FIG. 6 in difficulty, except it has additional difficulty due to dissimilar size parallelogram spaces.

Figure 8:
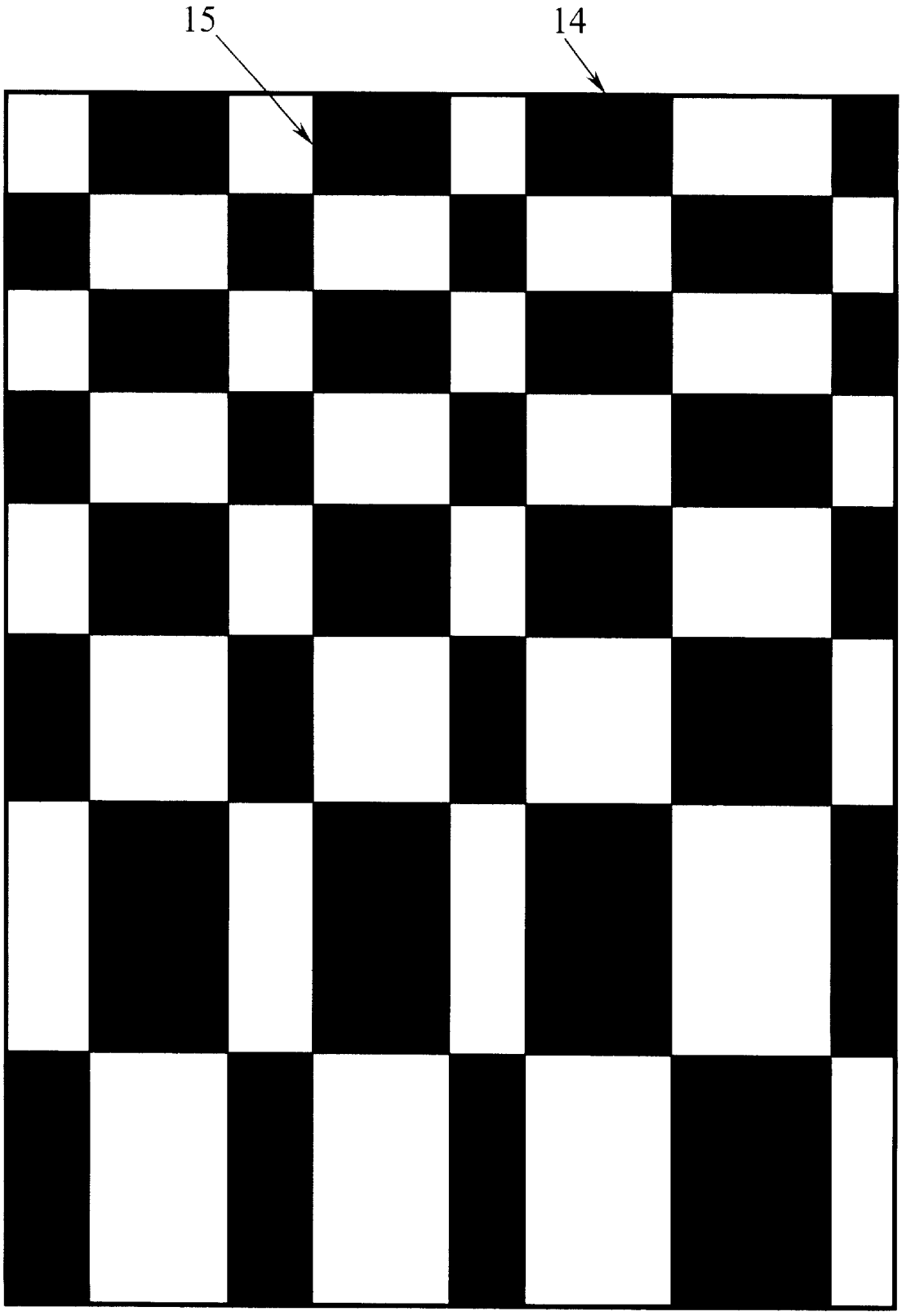
FIG. 8 is a rectangular like chessboard with uneven rectangular playing spaces.

FIG. 8 is an rectangular chessboard 14 with irregular size rectangles 15. The outside dimensions of FIG. 8 can be square to extreme in size such as eight inches by thirty inches. A player will have a lot more difficulty keeping track of his opponent's pieces when using different size rectangles such as this.

Figure 9:
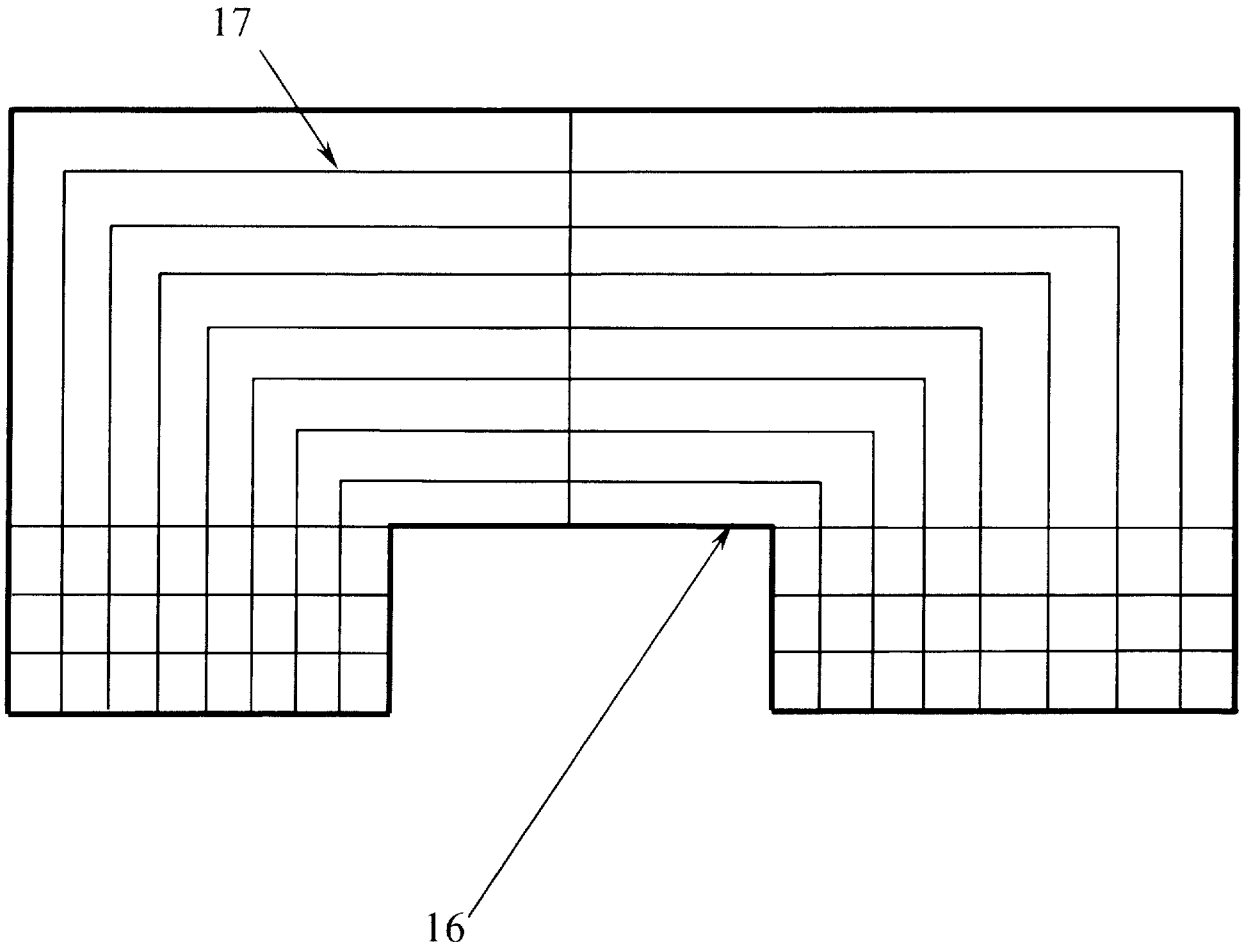
FIG. 9 is a polygon like chessboard where opponents play on the same side.

FIG. 9 is a polygon chessboard 16 similar to FIG. 2 whereby the players are on the same side. Again, as mention before the difficulty is in keeping track or concentrating on the opponent's moves and piece locations. FIG. 9 is one of many other possibilities for this design whereby all the lines 17 are straight. This design allows the manufacturer to visualize the extension of the lines 17 when designing FIG. 2 so as to allow for comfortable seating distances of the opponents. The design makes for an interesting airline chess board game where the opponents are on the same side.

Figure 10:
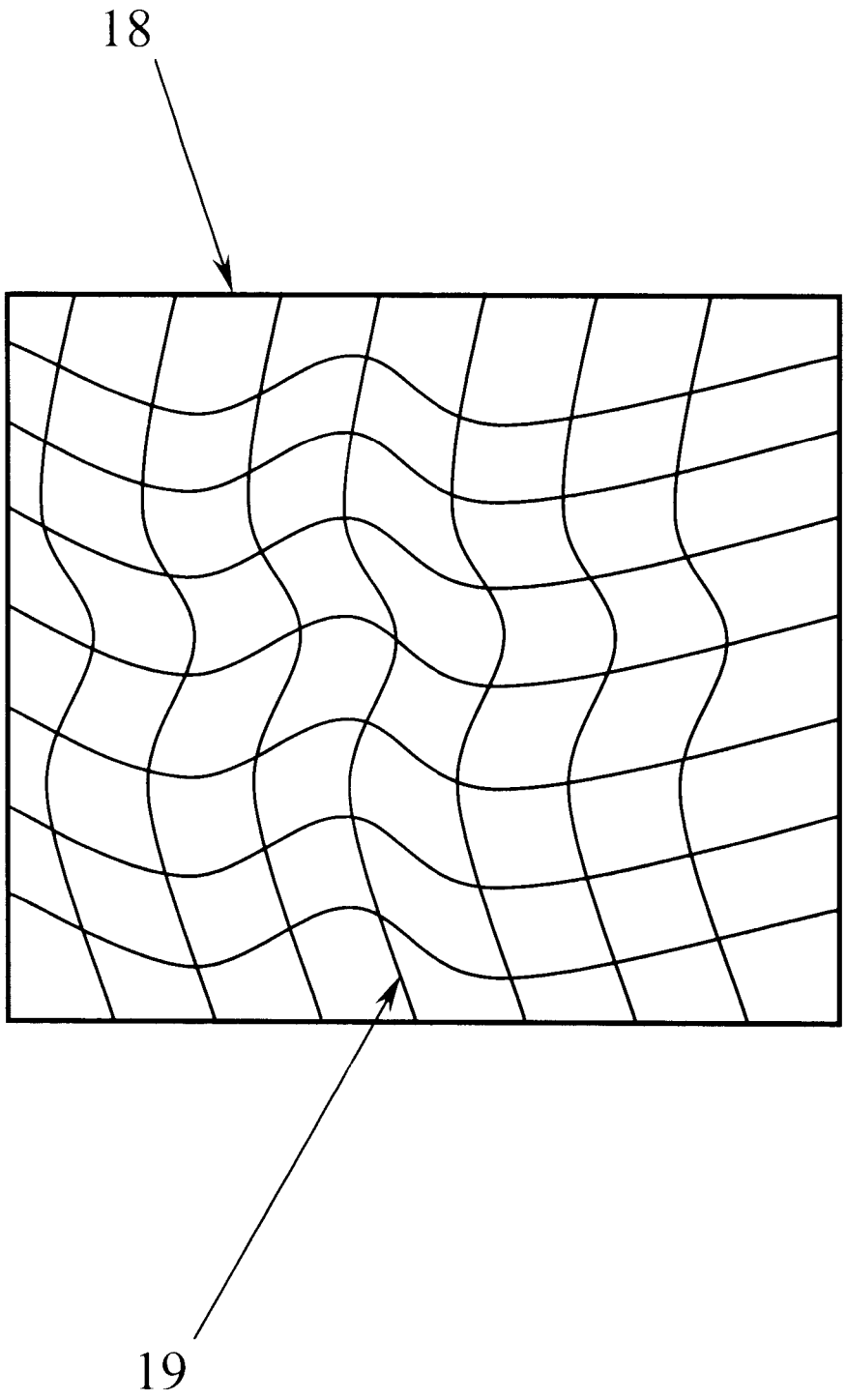
FIG. 10 is a square chessboard with curving lines to outline the playing spaces.

FIG. 10 is a square chessboard 18 with curved lines 19. This form like the previous forms mentioned would be difficult to follow because of the curved lines. Curve line orientations can vary per manufacturer preferences.

Figure 11:
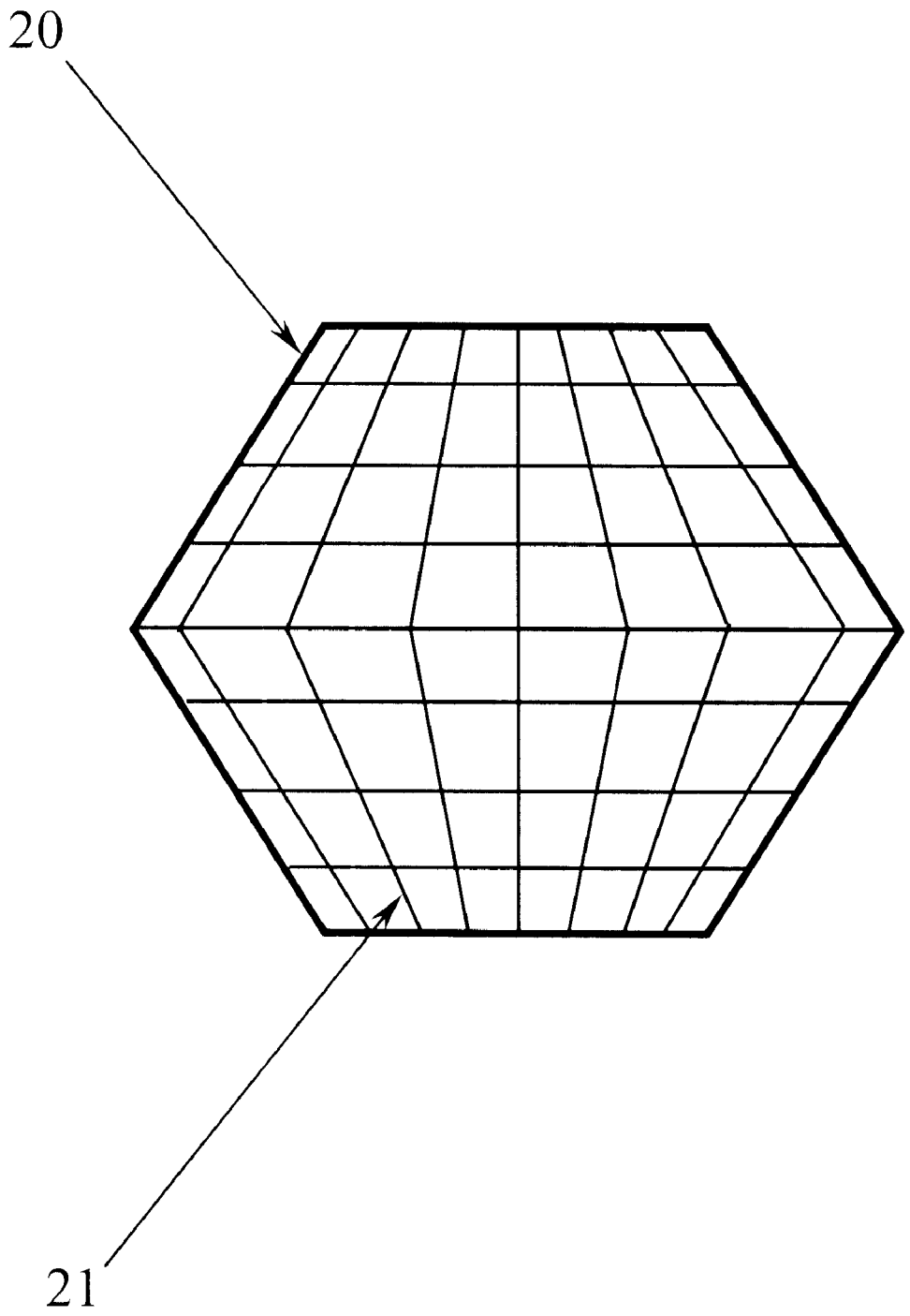
FIG. 11 is a chessboard in the shape of an octagon.

FIG. 11 is a hexagonal chessboard 20 with straight lines 21. Lines can also vary to curves, not shown, similar to FIG. 10 lines 19 and so can the type of polygon exterior perimeter shape from hexagon to pentagon and more What I have attempted to show with the various figures is that you can use anyone of the above oblique shaped boards and more to play a much more complex version of chess. FIGS. 6, 7, 8, 9, 10 and 11 show chessboards that are shown to better understand my curved oblique chessboard. These parallelogram like chessboards, although interesting to look at, would not be as challenging to play as let's say, FIG. 2, chessboard 3. Also note that I have provided various forms of the oblique chess board and other variation are possible such as color shading. Color variation of the alternating blocks can be for argument sake, dark green at one end to light green at the opposing side. And of course a more radical coloration could be to use various shades of red blocks against various shades of blue alternating blocks, similar to camouflaging.

While there has been shown and described a preferred embodiment of the oblique chessboard for this invention, there are other variations and modifications that will be readily apparent to those skilled in the art in light of the above teachings. It is therefore understood that changes in structure, material, sizes, shapes can be made by those skilled in the art without departing from the invention. The invention is defined in the following

What is claimed are:

1. A chessboard for a conventional chess game comprising:

a generally flat, two-dimensional oblique game board apparatus that is adapted for playing chess with a plurality of standard chess pieces controlled by two opposing players, said main oblique game board having an oblique perimeter comprising four curved side edges, the curved side edges including two opposing top and bottom curved side edges, and two opposing left and right curved side edges, said perimeter further comprising four curved corners connecting the ends of the curved side edges to from said perimeter;

a defining playing surface with a plurality of having a main oblique field with sixty-four oblique playing spaces juxtaposed fluid like to a side edge of said main oblique field;

said playing spaces have curved edges from a plurality of eight lines made from one playing edge and extending to the opposing imaginary playing edge;

said lines are intersected by an additional plurality of eight curved lines that intersect from an imaginary left to right side curved edge;

and said sixty-four spaces are alternate light and dark spaces.

2. The oblique game board of claim 1 wherein there is an open space within the playing field, said space is a blank playing space distiguishable from said sixty-four playing spaces, and said blank playing space is not formed from said curved lines.

3. The oblique game board of claim 2 wherein the blank space within the playing field is for the purpose of a different type board game.

4. The oblique game board of claim 1 wherein there is a plurality of open spaces within the playing field, said spaces are blank playing spaces distinguishable from said sixty-four playing spaces, and said blank playing spaces are not formed from said curved lines.

5. The oblique game board of claim 1 wherein thirty two playing spaces have color shading from light to dark shading from one side to opposing side and;

remaining thirty two alternating spaces have a different color shading from dark to light shading from one side to opposing side.

6. A chessboard of the conventional sixty-four alternate light and dark playing spaces for playing chess and accommodates a plurality of chess pieces controlled by two opposing players comprising;

a flat two dimensional polygon like perimeter playing field with straight outer edges;

the playing spaces have straight edges within said playing field made form a plurality of eight straight lines intersected by an additional plurality of eight straight lines creating the sixty-four identifiable said playing spaces;

said spaces are all four sided polygons;

said lines are spaced apart at various distances from each other such that each said playing spaces are a different size dimension from one another, and no two playing spaces have the same size dimension.

* * * * *